US007198119B1

(12) United States Patent
Hall et al.

(10) Patent No.: US 7,198,119 B1
(45) Date of Patent: Apr. 3, 2007

(54) HYDRAULIC DRILL BIT ASSEMBLY

(76) Inventors: David R. Hall, 2185 S. Larsen Pkwy., Provo, UT (US) 84606; Francis E. Leany, 2185 S. Larsen Pkwy., Provo, UT (US) 84606; Scott S. Dahlgren, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/306,022

(22) Filed: Dec. 14, 2005

Related U.S. Application Data

(63) Continuation-in-part of application No. 11/164,391, filed on Nov. 21, 2005.

(51) Int. Cl.
*E21B 10/26* (2006.01)

(52) U.S. Cl. ..... 175/57; 175/381; 175/385; 175/404

(58) Field of Classification Search ..... 175/404, 175/403, 405.1, 408, 420.2, 385, 386, 379, 175/381, 57, 321
See application file for complete search history.

(56) References Cited

U.S. PATENT DOCUMENTS

| | | | | |
|---|---|---|---|---|
| 465,103 | A | 12/1891 | Wegner | |
| 616,118 | A | 12/1898 | Kuhne | |
| 946,060 | A | 1/1910 | Looker | |
| 1,116,154 | A | 11/1914 | Stowers | |
| 1,183,630 | A | 5/1916 | Bryson | |
| 1,189,560 | A | 7/1916 | Gondos | |
| 1,360,908 | A | 11/1920 | Everson | |
| 1,387,733 | A | 8/1921 | Midgett | |
| 1,460,671 | A | 7/1923 | Hebsacker | |
| 1,544,757 | A | 7/1925 | Hufford | |
| 1,821,474 | A | 9/1931 | Mercer | |
| 2,054,255 | A | 9/1936 | Howard | |
| 2,169,223 | A | 8/1939 | Christian | |
| 2,218,130 | A | 10/1940 | Court | |
| 2,320,136 | A | 5/1943 | Kammerer | |
| 2,345,024 | A * | 3/1944 | Bannister | 173/31 |
| 2,466,991 | A | 4/1949 | Kammerer | |
| 2,540,464 | A | 2/1951 | Stokes | |
| 2,544,036 | A | 3/1951 | Kammerer | |
| 2,755,071 | A | 7/1956 | Kammerer | |
| 2,819,041 | A * | 1/1958 | Beckham | 175/93 |
| 2,873,093 | A * | 2/1959 | Hildebrandt et al. | 175/92 |
| 2,901,223 | A | 8/1959 | Scott | |
| 2,963,102 | A | 12/1960 | Smith | |
| 2,998,085 | A * | 8/1961 | Dulaney | 175/100 |
| 3,379,264 | A | 4/1968 | Cox | |
| 3,493,165 | A | 2/1970 | Schonfeld | |
| 3,815,692 | A * | 6/1974 | Varley | 175/65 |

(Continued)

*Primary Examiner*—Hoang Dang
(74) *Attorney, Agent, or Firm*—Tyson J. Wilde

(57) ABSTRACT

In one aspect of the present invention a drill bit assembly has a body portion intermediate a shank portion and a working portion. The working portion has at least one cutting element and the body portion has at least a portion of a jackleg apparatus. The jackleg apparatus has at least a portion of a shaft disposed within a chamber; the shaft has a distal end. The jackleg apparatus has a hydraulic compartment adapted to displace the distal end of the shaft relative to the working portion. The chamber also has an opening proximate the working portion of the assembly. The hydraulic compartment may be part of a hydraulic circuit which has a pump. The pump may have a first section with is rotationally fixed to the body portion and a second section rotationally isolated from the body portion.

20 Claims, 16 Drawing Sheets

U.S. PATENT DOCUMENTS 3,960,223 A 6/1976 Kleine
4,081,042 A 3/1978 Johnson
4,106,577 A 8/1978 Summers
4,307,786 A 12/1981 Evans
4,386,669 A * 6/1983 Evans ..... 175/269
4,416,339 A 11/1983 Baker
4,448,269 A 5/1984 Ishikawa
4,531,592 A 7/1985 Hayatdavoudi
4,566,545 A 1/1986 Story
4,962,822 A 10/1990 Pascale
5,009,273 A 4/1991 Grabinski
5,038,873 A 8/1991 Jurgens
5,088,568 A * 2/1992 Simuni ..... 175/14
5,141,063 A 8/1992 Quesenbury
5,361,859 A 11/1994 Tibbitts
5,388,649 A * 2/1995 Ilomaki ..... 175/27
5,417,292 A 5/1995 Polakoff
5,507,357 A 4/1996 Hult
5,560,440 A 10/1996 Tibbitts
5,568,838 A 10/1996 Struthers
5,678,644 A 10/1997 Fielder
5,896,938 A 4/1999 Moeny
6,202,761 B1 3/2001 Forney
6,439,326 B1 8/2002 Huang
6,533,050 B2 3/2003 Molloy
6,601,454 B1 8/2003 Botnan
6,668,949 B1 12/2003 Rives
6,732,817 B2 5/2004 Dewey
6,929,076 B2 8/2005 Fanuel
6,953,096 B2 10/2005 Gledhill

* cited by examiner

HYDRAULIC DRILL BIT ASSEMBLY

CROSS REFERENCE TO RELATED APPLICATIONS

This Patent application is a continuation-in-part of U.S. patent application Ser. No. 11/164,391 filed on Nov. 21, 2005 and entitled Drill Bit Assembly, which is herein incorporated by reference in its entirety.

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit whirl in hard formations may result in damage to the drill bit and reduce penetration rates. Further loading too much weight on the drill bit when drilling through a hard formation may exceed the bit's capabilities and also result in damage. Too often unexpected hard formations are encountered suddenly and damage to the drill bit occurs before the weight on the drill bit can be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

In one aspect of the present invention a drill bit assembly comprises a body portion intermediate a shank portion and a working portion. The working portion has at least one cutting element. The body portion has a jackleg apparatus which has at least a portion of a shaft disposed within a chamber of the body portion, the shaft having a distal end. The jackleg also comprises a hydraulic compartment adapted for displacement of the distal end of the shaft relative to the working portion. The displacement may be accomplished by pressurizing one or more sections of the hydraulic compartment such that the shaft, the working portion, or both move with respect to the body portion. The chamber also has an opening proximate the working portion of the assembly. At least a portion of the hydraulic compartment may be disposed within the chamber. At least a portion of the shaft is also disposed within a hydraulic compartment. The hydraulic compartment may be disposed within the chamber or it may be disposed outside of the chamber. In the preferred embodiment, the shank portion is adapted for connection to a downhole tool string component for use in oil, gas, and/or geothermal drilling; however, the present invention may be used in drilling applications involved with mining coal, diamonds, copper, iron, zinc, gold, lead, rock salt, and other natural resources, as well as for drilling through metals, woods, plastics and related materials.

In some aspects of the present invention, the hydraulic compartment may have a first and a second section, which is separated by an enlarged portion of the shaft. A sealing element may be disposed between the shaft and a wall of the hydraulic compartment which may prevent leaks between the first and second sections. The hydraulic compartment may be part of a hydraulic circuit which has valves for pressurizing and exhausting the first and second sections of the compartment. A pump, which is also part of the hydraulic circuit, may supply the hydraulic pressure. The pump may be controlled electrically, by a turbine, or it may be controlled by differential rotation between a first section of the pump rotationally fixed to the body portion of the assembly and a second section of the pump rotationally isolated from the body portion. The valves may be controlled electrically and they may be in communication with a downhole telemetry system so that they may receive commands from the surface or from other downhole tools. In other embodiments pressure from the bore of the tool string (drilling mud, air, or other drilling fluid) may be used to pressurize the sections of the hydraulic compartment. Actuators may be used to open and/or close apertures in the hydraulic compartment, thereby allowing pressure from the bore of the tool string to enter and/or exhaust into or out of the hydraulic compartment.

The shaft may be retracted while the drill bit assembly is lowered into an existing borehole which may protect the shaft from damage. During a drilling operation the shaft may be extended such that the distal end of the shaft protrudes out of an opening proximate the working portion of the assembly. The distal end of the shaft may comprise at least one cutting element or various geometries for improving penetration rates, reducing bit whirl, and/or controlling the flow of debris from the subterranean formation.

The jackleg apparatus may be rotationally isolated from the body portion of the drill bit assembly or in other embodiments just the distal end of the shaft may be rotational isolated from the body portion. During a drilling operation, the distal end of the shaft may protrude beyond the opening of the chamber and be fixed against a subterranean formation. In some embodiments the entire shaft may be fixed with respect to the subterranean formation while the body portion rotates around the shaft. In such embodiments, a fixed distal end may act as a reference enabling novel methods for controlling drill bit dynamics involving stabilization and controlling the amount of weight loaded to the working portion of the assembly.

In embodiments where hydraulic pressure moves the shaft, the position of the shaft depends on the pressures within the first and second sections as well as the formation pressure of the subterranean formation if the distal end of the shaft is in contact with the formation. In soft subterranean formations, the distal end may travel a maximum distance into the formation, in such an embodiment the shaft may stabilize the drill bit assembly as it rotates reducing vibrations of the tool string. In harder formations the compressive strength of the formation may resist the axial and/or rotational movement of the shaft. In such an embodiment, the jackleg apparatus may absorb some of the formation's resistance and also transfer a portion of the resistance to the tool string through the first section of the hydraulic compartment. In such embodiments, at least a portion of the weight of the tool string will be loaded to the shaft focusing the weight of the tool string immediately in front of the distal end of the shaft and thereby penetrating a portion of the subterranean formation. Since at least a portion of the weight of the tool string is focused in the distal end, bit whirl may be minimized even in hard formations. In such a situation, depending on the geometry of the distal end of the shaft, the distal end may force a portion of the subterranean formation outward placing it in a path of the cutting elements.

Still referring to embodiments where the hydraulic pressure moves the shaft, another useful result of loading the shaft with the weight of the tool string is that it subtracts some of the load felt by the working portion of the drill bit assembly. By subtracting the load on the working portion automatically through the jackleg apparatus when an unknown hard formation is encountered, the cutting elements may avoid sudden impact into the hard formation which may potentially damage the working portion and/or the cutting elements.

In embodiments where the hydraulic pressure moves the working portion of the assembly, loading weight of the tool string to the shaft allows precise metering of the actual weight loaded to the working portion that may be monitored from the surface over a downhole network. This allows the weight loaded to the working portion to be controlled accurately because formation pressures and characteristics may be sensed and accounted for in real-time.

The shaft may be disposed within a sleeve that is rotationally isolated from the body portion. The shaft and/or its distal end may also be rotationally isolated from the body portion of the drill bit assembly. Rotational isolation may reduce the wear felt by the distal end of the shaft and prolong its life. The distal end of the shaft may comprise a superhard material. Such a material may be diamond, polycrystalline diamond, boron nitride, or a cemented metal carbide. The shaft may also comprise a wear resistant material such a cemented metal carbide, preferably tungsten carbide.

The shaft may be in communication with a device disposed within the tool string component and/or in the body portion of the drill bit assembly which is adapted to rotate the shaft with respect to the body portion. The device may comprise a turbine or a planetary gear system. The device may rotate the shaft clockwise or counterclockwise.

DETAILED DESCRIPTION OF THE INVENTION AND THE PREFERRED EMBODIMENT

Figure 1:
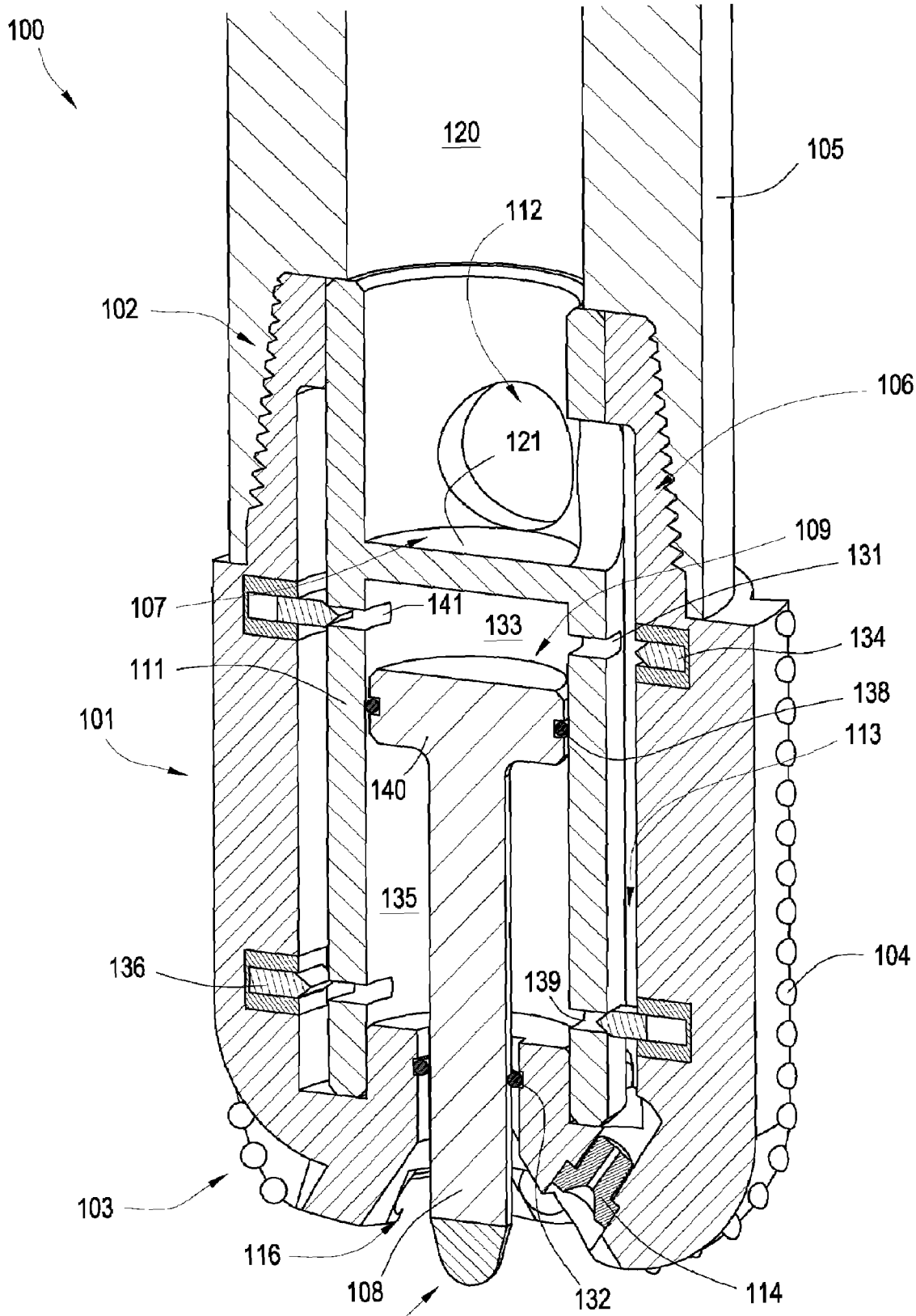
FIG. 1 is a cross sectional diagram of an embodiment of a drill bit assembly.

FIG. 1 is a cross sectional diagram of an embodiment of a drill bit assembly 100. The drill bit assembly 100 comprises a body portion 101 intermediate a shank portion 102 and a working portion 103. In this embodiment, the shank portion 102 and body portion 101 are formed from the same piece of metal although the shank portion 102 may be welded or otherwise attached to the body portion 101. The working portion 103 comprises a plurality of cutting elements 104. In other embodiments, the working portion 103 may comprise cutting elements 104 secured to a roller cone or the drill bit assembly 100 may comprise cutting elements 104 impregnated into the working portion 103. The shank portion 102 is connected to a downhole tool string component 105, such as a drill collar, drill pipe, or heavy weight pipe, which may be part of a downhole tool string used in oil, gas, and/or geothermal drilling.

A reactive jackleg apparatus 106 is generally coaxial with the shank portion 102 and disposed within the body portion 101. The jackleg apparatus 106 comprises a chamber 107 disposed within the body portion 101 and a shaft 108 is movably disposed within the chamber 107. The shaft 108 comprises a proximal end 109 and a distal end 110. A sleeve 111 is disposed within the chamber 107 and surrounds the shaft 108. The sleeve 111, a plate 121 and a portion of the body portion 101 form a hydraulic compartment 130. Sealing elements 132 disposed between the shaft 108 and the chamber 107 may be used to keep hydraulic pressure from escaping. The hydraulic pressure may come from a closed loop hydraulic circuit or it may come from a drilling fluid such as drilling mud or air.

Still referring to FIG. 1, the bore 120 of the downhole tool string component 105 is pressurized with drilling mud. At least some of the drilling mud is released through a port 112 formed in the chamber 107 which leads to at least one nozzle 114 secured in the working portion of the assembly 100. A fluid channel 113 directs the drilling mud from the port 112 to the at least one nozzle 114. Pressure from the bore 120 may enter a first section 133 of the hydraulic compartment 130 through a first aperture 131 formed in the hydraulic compartment 130 and exposed in a fluid channel 113. A first actuator 134 may be used to control the amount of pressure allowed to enter the first section 133 by selectively opening or closing the aperture 131. The first actuator 134 may comprise a latch, hydraulics, a magnetorheological fluid, eletrorheological fluid, a magnet, a piezoelectric material, a magnetostrictive material, a piston, a sleeve, a spring, a solenoid, a ferromagnetic shape memory alloy, or combinations thereof. When the first aperture 131 is open, a second aperture 136 formed in a second section 135 of the hydraulic compartment 130 may also be open. The second aperture 136 may be exposed in another fluid channel 137 which is isolated from the pressure of the bore 120 and is in fluid communication with the outside surface of the drill bit assembly 100. In such an embodiment, as pressure enters the first section 133, pressure may be exhausted from the second section 135. Since the sections 133, 135 of the hydraulic compartment 130 are separated by an enlarged portion 140 of the shaft 108 and a sealing element 138 keeps pressure from escaping from one section to another, the shaft 108 will move such that the distal end 110 of the shaft 108 will extend beyond the opening 116 of the chamber 107.

When the first and second apertures 131, 136 are closed, a third and fourth aperture 139, 141 may be opened; aperture 139 may pressurize the second section 135 and aperture 141 may exhaust the first section 133. In this manner the shaft 108 may be retracted. When all of the apertures are closed 131, 136, 139, 141 the shaft 108 may be held rigidly in place. Thus the equilibrium of the section pressures may be used to control the position of the shaft 108. During a drilling operation, the distal end 110 of the shaft 108 may engage the formation, which will exert a formation pressure on the shaft 108 and change the pressure equilibrium and there by change the position of the shaft 108.

While drilling through soft subterranean formations, it may be desirable to extend the shaft 108 a maximum distance to stabilize the drill bit assembly 100. In harder subterranean formations, the pressure equilibrium may change and automatically shift the shaft 108 into the chamber 107. As the formation pressure pushes against the shaft 108, a portion of the load on the working portion 103 of the drill bit assembly 100 may be transferred to the shaft 108. Thus the increased load on the shaft 108 may be focused to the region of the subterranean formation proximate the distal end 110 of the shaft 108 and improve the penetration rate through the hard formation. Thus the reactive jackleg apparatus 106 may stabilize the drill bit assembly 100, absorb some of the sudden impact when encountering unexpected hard formations, and/or reduce damage to the working portion 103 of the drill bit assembly 101.

The shaft 108 may be generally cylindrically shaped, generally rectangular, or generally polygonal. The shaft 108 may be keyed or splined within the chamber 107 to prevent the shaft 108 from rotating independently of the body portion 101; however, in the preferred embodiment, the shaft 108 is rotationally isolated from the body portion 101. Preferably, the distal end 110 comprises diamond bonded to the rest of the shaft 108. The diamond may be bonded to the shaft 108 with any non-planar geometry at the interface between the diamond and the rest of the shaft 108. The diamond may be sintered to a carbide piece in a high temperature high pressure press and then the carbide piece may be bonded to the rest of the shaft 108. The shaft 108 may comprise a cemented metal carbide, such as tungsten or niobium carbide. In some embodiments, the shaft 108 may comprise a composite material and/or a nickel based alloy. During manufacturing, the chamber 107 may be formed in the body portion 101 with a mill or lathe. The reactive jackleg apparatus 106 may be inserted from the shank portion 102.

Figure 2:
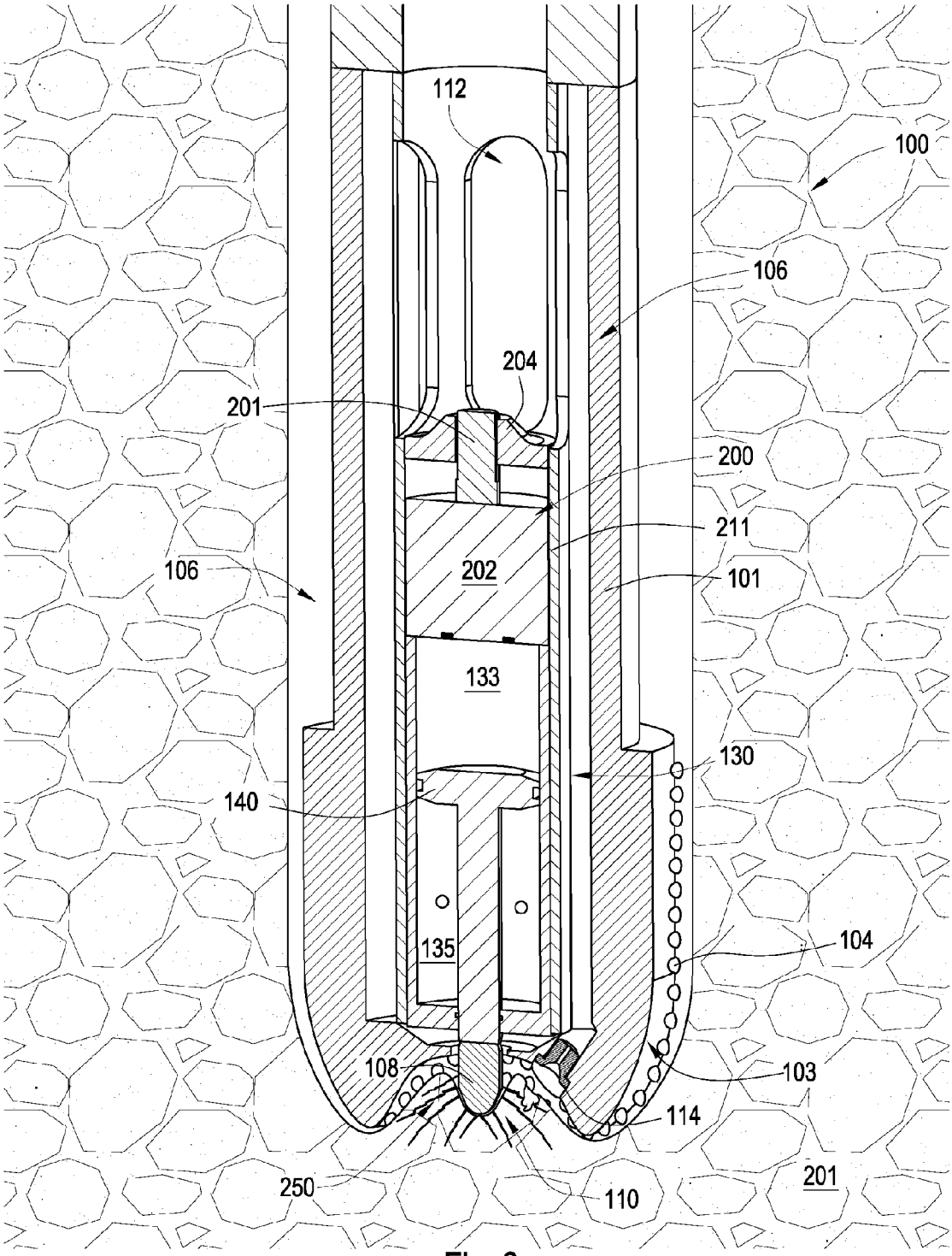
FIG. 2 is a cross sectional diagram of the preferred embodiment of a drill bit assembly.

FIG. 2 is a cross sectional diagram of the preferred embodiment of a drill bit assembly 100. In this embodiment, the distal end 110 of the shaft 108 is extended contacting a subterranean formation and is rotationally fixed with respect to the formation. A low friction interface between sleeve 211 and the hydraulic compartment may 130 rotationally isolate a portion of the jackleg apparatus 106 from the body portion 101 of the assembly 100. Rotary bearings may be used to help rotationally isolate the portion of the jackleg apparatus. The bearings may be made of stainless steel, diamond, polycrystalline diamond, silicon nitride, or other ceramics.

Flutes formed in the distal end 110 or other means of anchoring may be used to prevent the distal end 110 from slipping and rotating occasionally with the body portion 101; however, it is believed that the shaft 108 will remain stationary with respect to the formation 201 due to the weight of the tool string pressing the shaft 108 into the formation 201 and/or the compressive strength of the formation.

The hydraulic compartment 130 may be rotationally fixed to the enlarged portion 140 of the shaft 108 and the second section 202 of a hydraulic pump 200, the first section 201 of the pump 200 being rotationally fixed to the body portion 101 of the assembly 100 via a plate 204. The differential rotation between the first and second portions 201 and 202 of the pump 200 may drive a hydraulic circuit 203 (see FIG. 3) which is used to supply hydraulic pressure to the first and second sections 133, 135 of the hydraulic compartment 130. The hydraulic circuit 203 may comprise the pump 200, at least one of the sections of the hydraulic compartment 130, fluid channels (not shown), and electrically controlled valves for opening or closing the fluid channels. The fluid channels may be formed between the sleeve 211 and the hydraulic compartment 130. There may be a separate high pressure and low pressure fluid channel in communication with the pump 200 and both sections 133, 135 of the hydraulic compartment 130. Thus as the valves open and close, the sections may be either pressurized or exhausted. Preferably, the hydraulic circuit 203 is a closed circuit using liquid or gas, but in some embodiments, drilling mud may supply the pump 200. Fluid ports 112 formed in the sleeve 211 may allow the drilling mud to bypass a portion of the jackleg apparatus 106 and exit the drill bit assembly 100 through the at least one nozzle 114.

The electrically controlled valves may be in communication with a downhole tool, an automatic feedback loop, or the surface. A downhole telemetry system may send control and/or power signals over the length of the tool string, through the drilling mud, or through the earth. In embodiments, where the telemetry system is a downhole network, the weight on the working portion of the assembly may be controlled electrically from the surface. Thus the position of the shaft 108 and therefore the amount of weight loaded to the working portion 103 of the assembly 100 may be controlled by the hydraulic circuit 203. The embodiment of FIG. 2 may also automatically shift the position of the shaft 108 in response to changes in the formation pressure thereby protecting the working portion 103 of the assembly 100 from potential damage.

In other embodiments, drilling mud or air may enter the pump 200 and be used to pressurize the sections 133, 135 of the hydraulic compartment 130. In such embodiments, each section 133, 135 may be in communication with the outside of the drill bit assembly 100 through a fluid channel. The pump 200 may comprise gears, internal or external pistons and/or a swash plate. In some embodiments of the present invention, the pump 200 may be controlled by an electric motor.

The distal end 110 of the shaft 108 may allow for faster penetrations rates into the formation 201. The distal end 110 of the shaft 108 may be compressed into a conical portion 250 of the formation 210 which is formed by the profile of the working portion 103 of the drill bit assembly 100. It is believed that the conical portion 250 may have a weaker compressive strength which allows the distal end 110 of the shaft 108 easier penetration into the formation 201. Once the shaft 108 has penetrated the conical portion 250, it may wedges itself in the formation 201 such that the shaft 108 is fixed to the formation 201. Also the shaft 108 may push at least part of the conical portion 250 towards the cutting elements 104.

Figure 3:
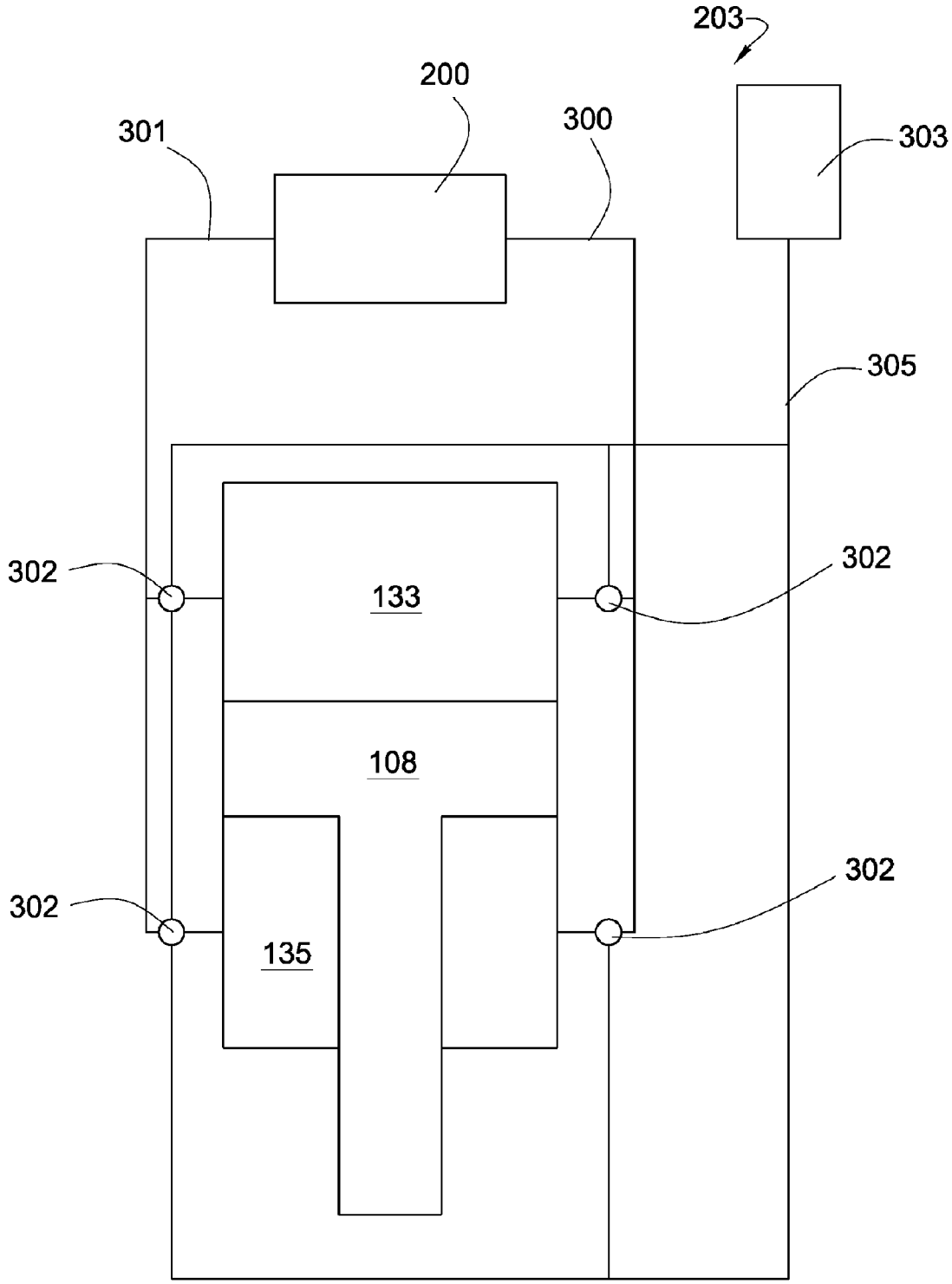
FIG. 3 is a cross sectional diagram of a preferred embodiment of a hydraulic circuit.
Figure 4:
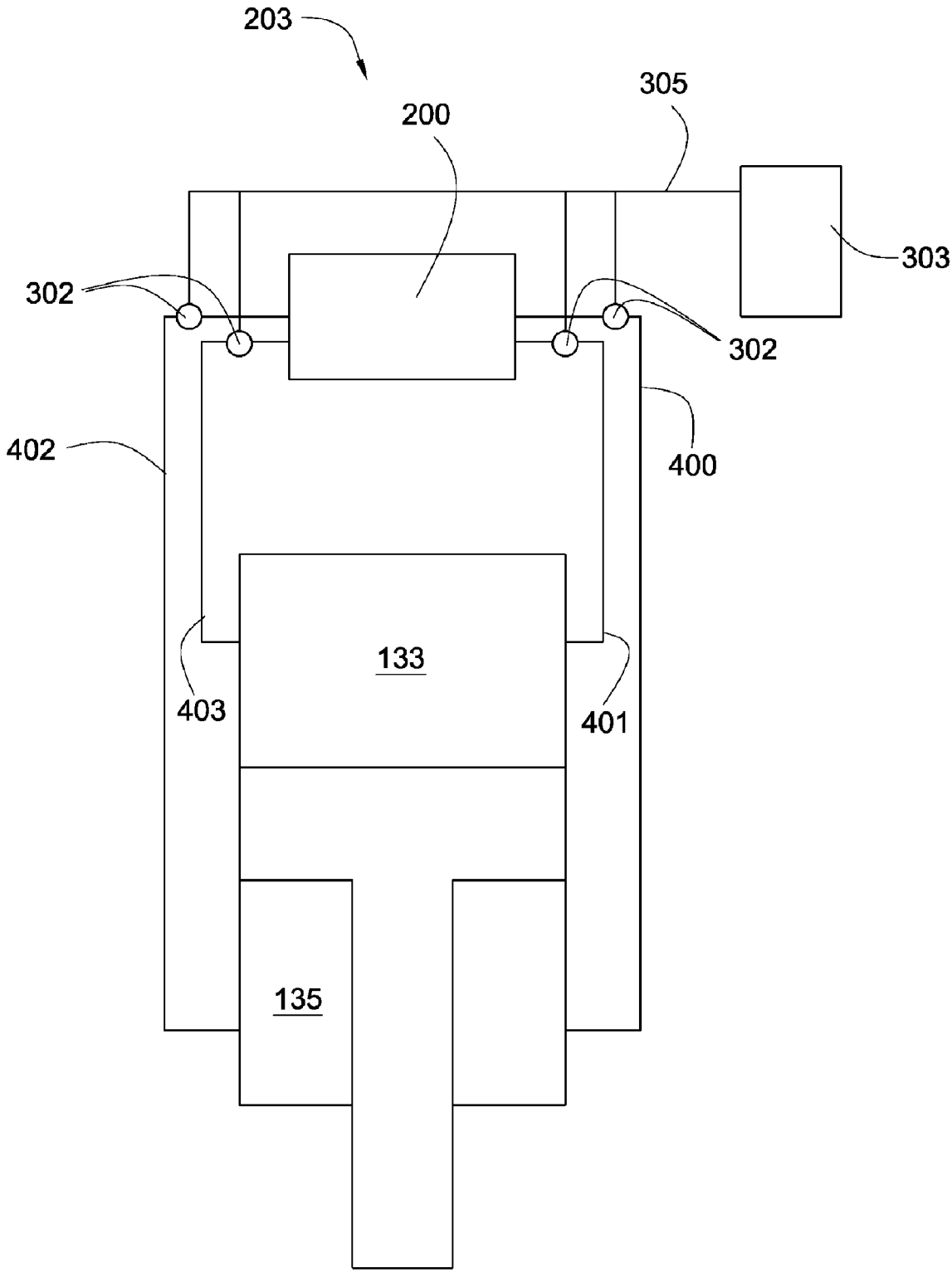
FIG. 4 is a cross sectional diagram of another embodiment of a hydraulic circuit.
Figure 5:
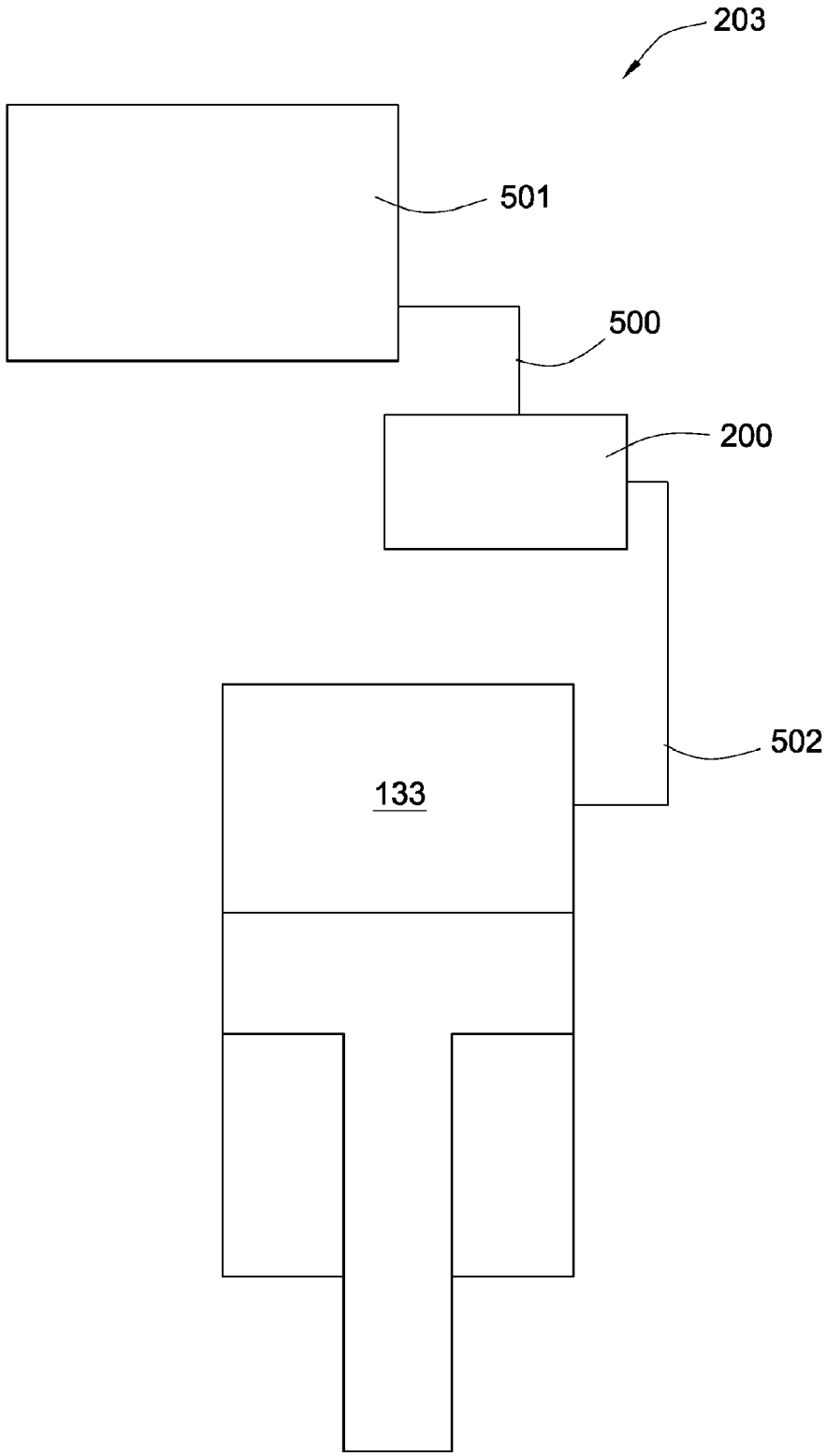
FIG. 5 is a cross sectional diagram of another embodiment of a hydraulic circuit.
Figure 6:
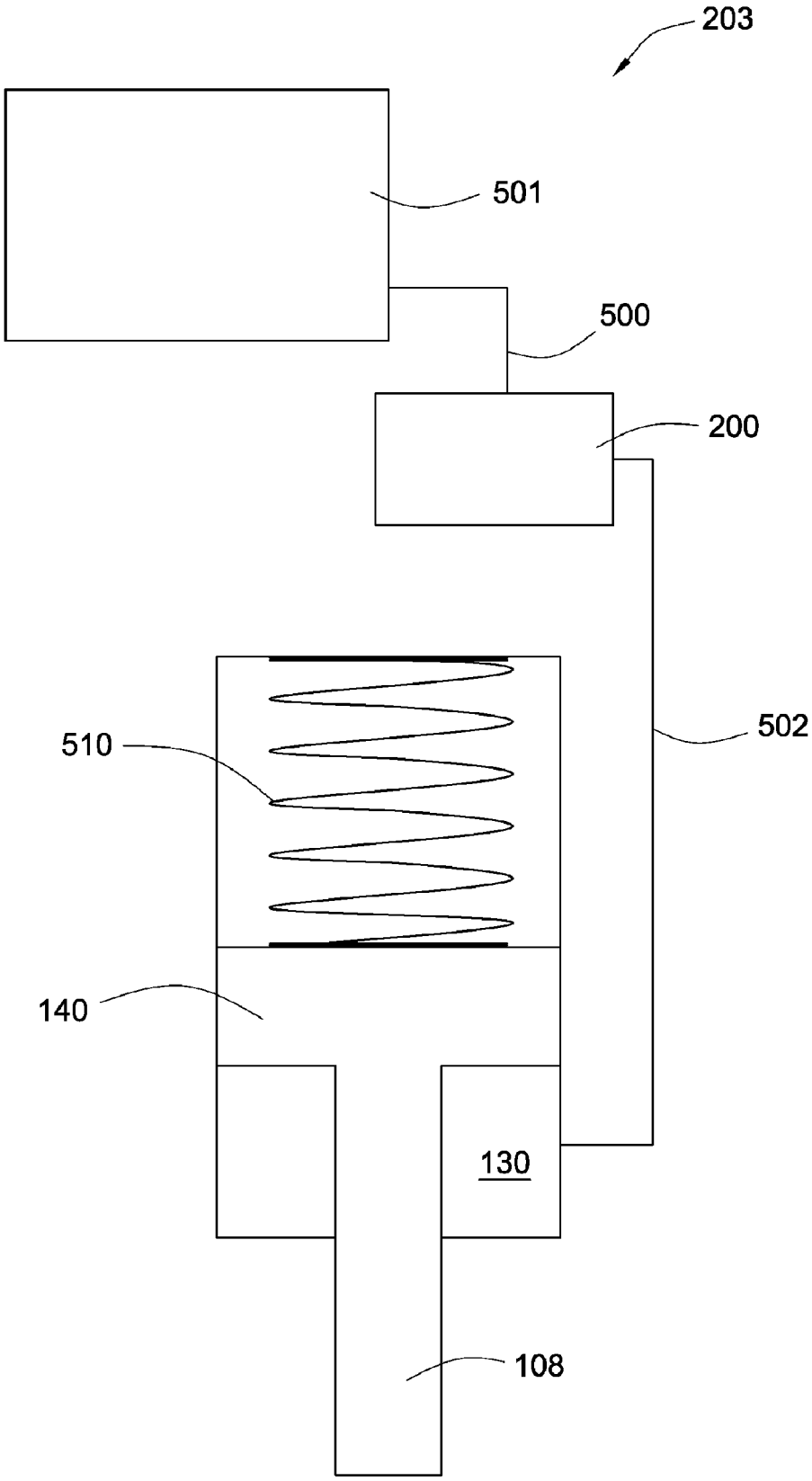
FIG. 6 is a cross sectional diagram of another embodiment of a hydraulic circuit.

FIG. 3 is a schematic diagram of a preferred embodiment of a hydraulic circuit 203. The pump 200 is connected to a high pressure fluid channel 300 and a low pressure fluid channel 301. Electrically controlled valves 302 are in communication with an electric module 303 via a transmission medium 305 for pressurizing the sections 133, 135 of the hydraulic compartment 130. FIG. 4 is another embodiment of a hydraulic circuit 203 which comprises a first and a second high pressure fluid channel 400, 401 and a first and a second low pressure fluid channel 403, 404 which are in communication with the pump 200. Again electrically controlled valves control the pressure in each of the sections 133, 135. FIG. 5 shows an embodiment of a hydraulic circuit 203 with a first fluid channel 500 in communication with a reservoir 501 of hydraulic fluid and a second fluid channel 502 in communication with the first section 133 of the hydraulic compartment 130. The pump 200 may alternate between pressurizing and exhausting the first section 133 via the second fluid channel 502. In alternative embodiment, an exhaust fluid channel may be used in conjunction with the second fluid channel 502. FIG. 6 shows an embodiment of a hydraulic circuit 203 where the hydraulic compartment is below the enlarged portion 140 of the shaft 108. In this embodiment a spring 510 may be used to force the shaft 108 to an extended position and the hydraulic pressure may be used to retract the shaft 108.

Figure 7:
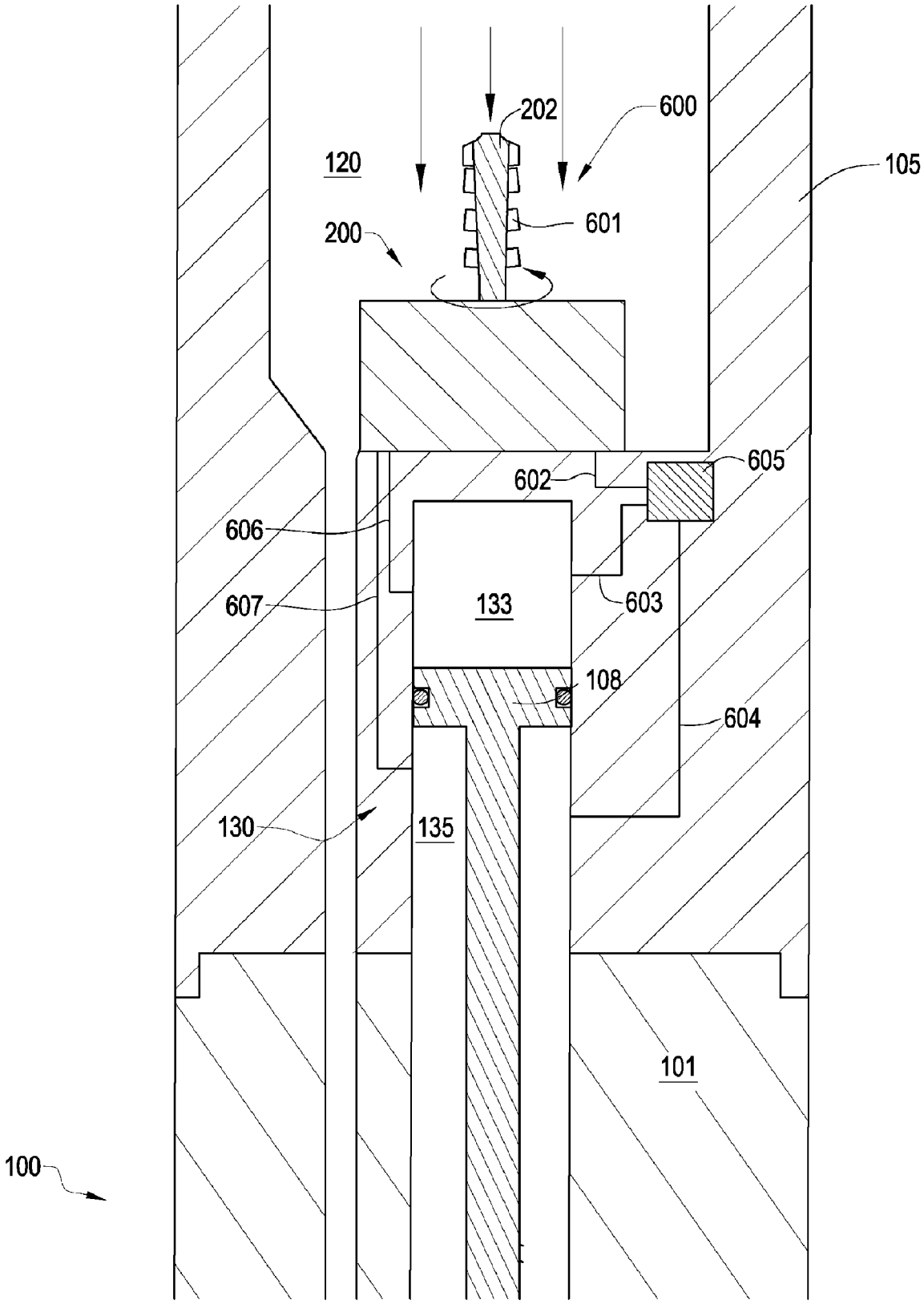
FIG. 7 is a cross sectional diagram of an embodiment of a turbine.

FIG. 7 is a cross sectional diagram of an embodiment of a turbine 600 for creating the differential pressure of the shaft 108. The turbine 600 is mounted on the section 202 of the pump 200 that is rotationally isolated from the body portion 101 of the assembly 100. The turbine 600 is adapted to rotate the first portion of the pump 200 and generate the differential rotation needed to pressurize the sections 133, 135 of the hydraulic compartment 130 as drilling mud travels through the bore 120 of the tool string component 105 and engages the blades 301 of the turbine 300. A first fluid channel 602 may be in communication with the pump 200 and a hydraulic fluid distributor 605 which comprises electrically controlled valves which direct pressure to either a second or third fluid channel 603, 604 to either pressurize the first or second section 133, 135 of the hydraulic compartment 130. Fluid channels 606 and 607 may be used to return the fluid to the pump 200. The embodiment of FIG. 7 has at least a portion of the hydraulic compartment 130 disposed within the body portion 101 of the assembly 100. In other embodiments, the hydraulic compartment 130 may be entirely disposed with the downhole tool string component 105 or entirely disposed within the body portion 101 of the assembly 100. The fluid distributor 605 may be in communication with other downhole tools or surface equipment over a network (shown in FIG. 9) and may also be part of a closed loop control system.

Figure 8:
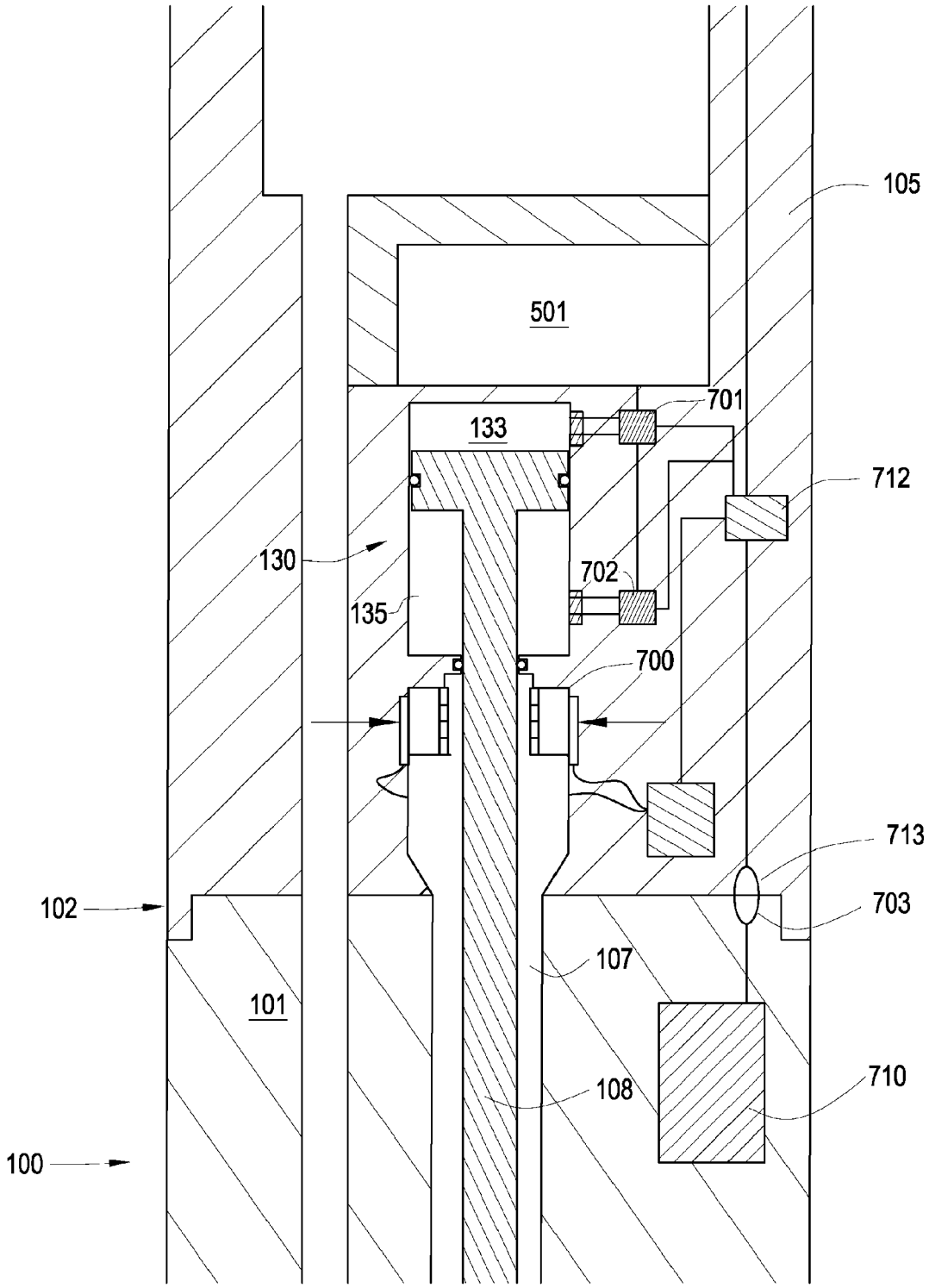
FIG. 8 is a cross sectional diagram of another embodiment of a drill bit assembly.

FIG. 8 is a cross sectional diagram of an engaging mechanism 700. It may be desirable to have the shaft 108 of the reactive jackleg apparatus 106 rotate with the body portion 101 temporally in some subterranean formations or to generate hydraulic power. The engaging mechanism 700 may squeeze the shaft 108 enough to fix the rotation of the shaft 108 with the rotation of the body portion 101. The engaging mechanism 700 may comprise a latch, hydraulics, a magnetorheological fluid, an eletrorheological fluid, a magnet, a piezoelectric material, a magnetostrictive material, a piston, a sleeve, a spring, a solenoid, a ferromagnetic shape memory alloy, or combinations thereof. The engaging mechanism 700 is shown in the tool string component 105, but the engaging mechanism 700 may also be placed within the body portion 101 of the drill bit assembly 100.

In the embodiment of FIG. 8, a reservoir 501 is in communication with a first and second fluid distributor 701, 702 which control the pressure of the first and second sections 133, 135 of the hydraulic compartment 130. Sealing elements 132 prevent hydraulic fluid from leaking into the chamber 107.

A drilling instrument 710 disposed within the body portion 101 of the drill bit assembly 100 is shown in communication with electronics 712 in the tool string component 105. The electronics 712 may control when the engaging mechanism 700 is in operation. Transmission elements 713 and 703 are shown at the connection between the shank portion 102 and the tool string component 105. The electronics 712 in the tool string component 105 may send or receive commands to the drilling instruments 710. In some embodiments the commands may be received from the surface over a downhole network.

Figure 9:
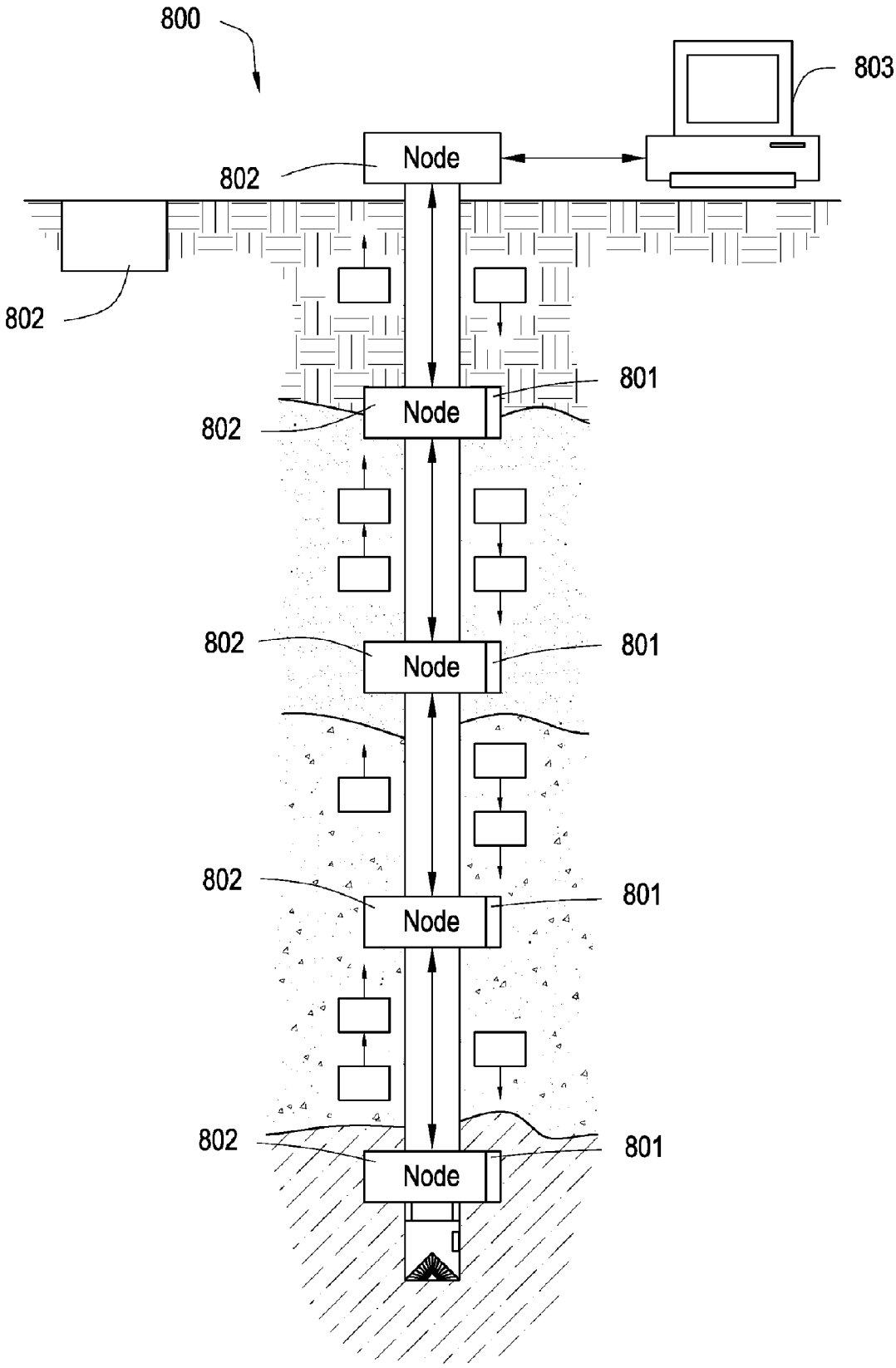
FIG. 9 is a perspective diagram of an embodiment of a downhole network.

FIG. 9 is a perspective diagram of an embodiment of a downhole network 800. The electronics 712 and/or drilling instruments 710 may be in communication with surface equipment or downhole tools. Such networks as described in U.S. Pat. Nos. 6,670,880; 6,717,501; 6,929,493; 6,688,396; and 6,641,434, which are all herein incorporated by reference for all that they disclose, may be compatible with the present invention. Preferably sensors 801 are associated with interconnected nodes 801. The sensors 801 may record an analog signal and transmit it to an associated node 802, where is it converted to digital code and transmitted to the surface via packets. In the preferred embodiment, the transmission elements disclosed in U.S. Pat. No. 6,670,880 are disposed within grooves formed in secondary shoulders at both the pin and box ends of a downhole tool string component. The signal may be passed from one end of the tool string component to another end via a transmission media secured within the tool string component. At the ends of the tool string component, the signal is converted into a magnetic signal by a transmission element and passed between the interface of the two tool sting components. Another transmission element in the adjacent tool string component converts the signal back into an electrical signal and passes it along another transmission media to the other end of the adjacent tool string component. This process may be repeated until the signal finally arrives at surface equipment, such as a computer, or at a target downhole location. The signal may attenuate each time it is converted to a magnetic or electric signal, so the nodes 802 may repeat or amplify the signals. A server 803 may be located at the surface which may direct the downhole information to other locations via local area networks, wireless transceivers, satellites, and/or cables.

Figure 10:
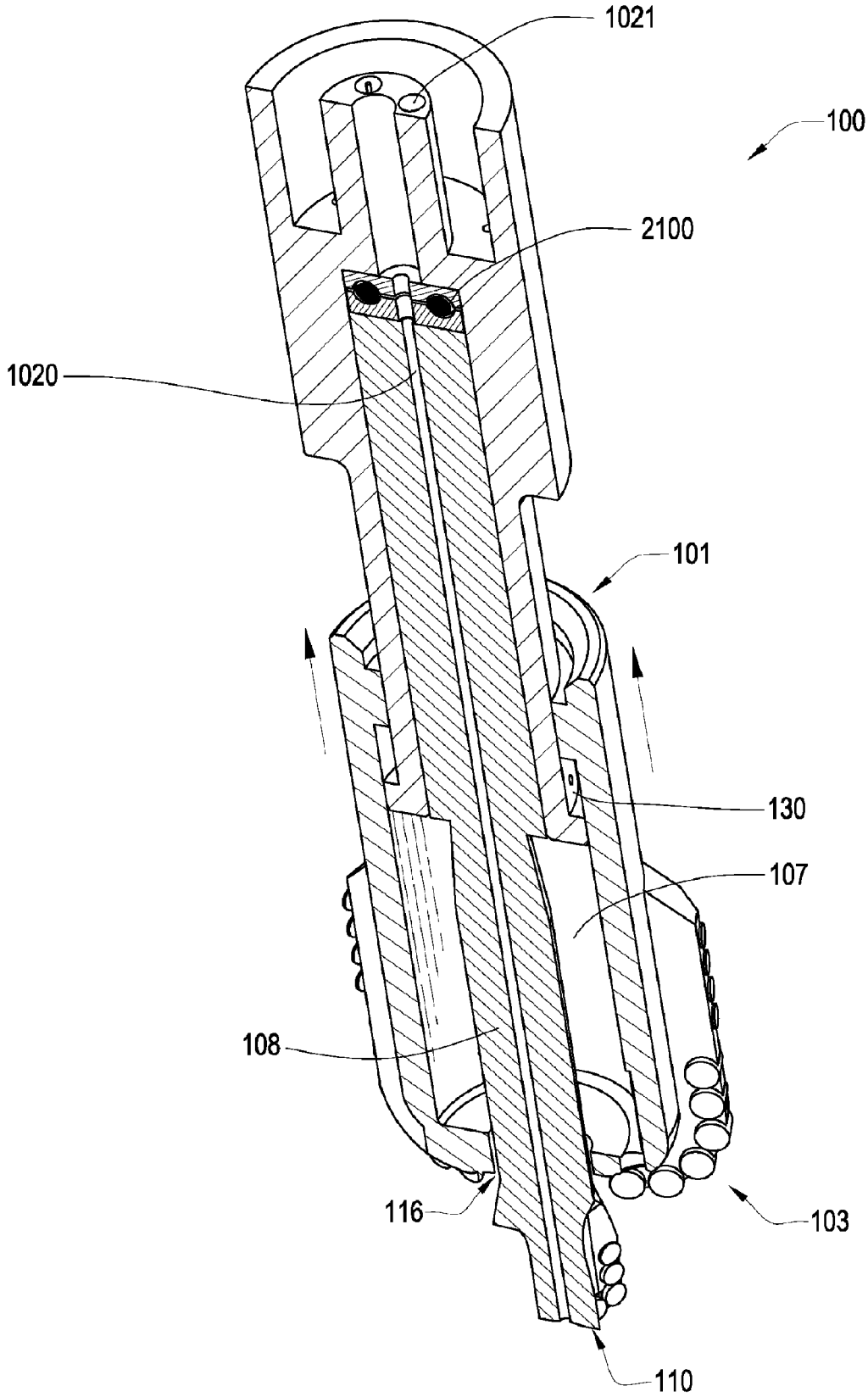
FIG. 10 is a cross sectional diagram of another embodiment of a drill bit assembly.

FIG. 10 is a cross sectional diagram of another embodiment of a drill bit assembly 100. In this embodiment, the hydraulic compartment 130 is disposed outside of the chamber 107. As the hydraulic pressure enters or exits the hydraulic compartment 130, the working portion 103 of the assembly 100 will move, thereby displacing the distal end 110 of the shaft 108 relative to the working portion 103. The shaft 108 may be rigidly secured within the body portion 101 and as the working portion 103 of the assembly 100 moves the weight of the tool string that was loaded to the working portion 103 may be transferred to the shaft 108. In this manner the weight loaded to the working portion may be precisely controlled. The hydraulic pressure may come from the drilling mud, air, or it may come from a closed loop hydraulic circuit 203 (see FIGS. 3–6). When the hydraulic compartment is exhausted, the weight loaded to the shaft 108 may be reduced. Rotary bearings 2100 may be used to rotationally isolate the shaft 108 from the body portion 101 of the assembly 100. The differential rotation between the shaft 108 and the body portion 101 may be used to drive a fluid pump 200 (shown in FIG. 2). In other embodiments, the hydraulic pressure may be controlled over a downhole network. Drilling mud may travel through the shaft via a fluid channel 1020 or the drilling mud may enter a bypass channel 1021, enter into the chamber 107 and exit through an opening 116 of the chamber 107 which is proximate the working portion 103.

Figure 11:
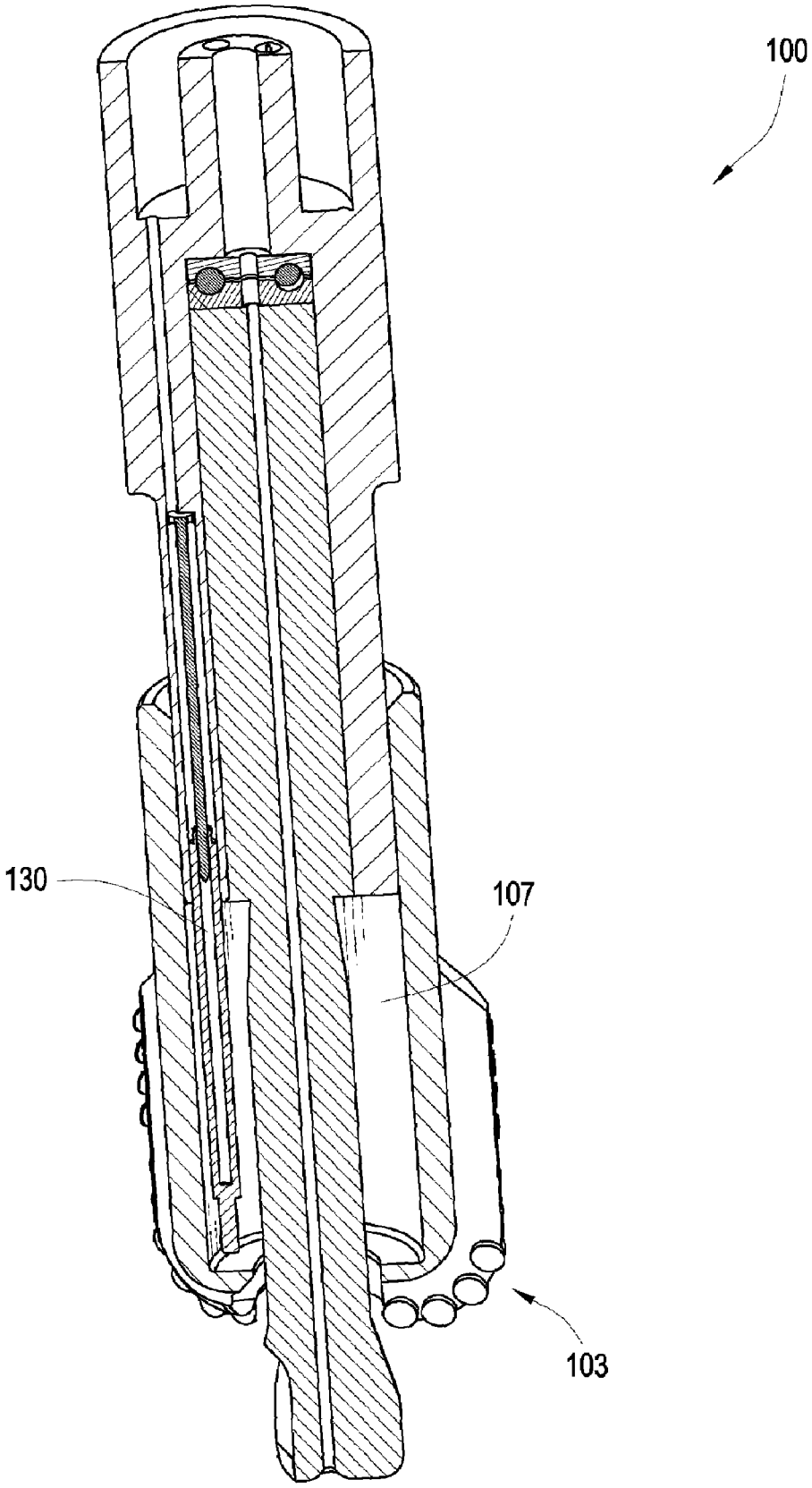
FIG. 11 is a cross sectional diagram of another embodiment of a drill bit assembly.

FIG. 11 is a cross section diagram of another embodiment of a drill bit assembly 100 also capable of moving it's working portion 103. The hydraulic compartment 130 is partially disposed within the chamber 107 and may be part of a hydraulic circuit run by a turbine. Only one hydraulic compartment is shown, but it would be obvious to one of ordinary skill in the art to include as many hydraulic compartments as desired. The hydraulic compartment 130 may be associated with a linear variable displacement transducer, a weight sensor, and/or another position sensor. The location of the working portion 103 may be sent over the network 800 (see FIG. 9) such that the surface may control the weight loaded to the working portion 103 of the assembly 100 electrically from the surface. Since the weight loaded to the working portion 103 of the drill bit assembly 100 may be controlled from the surface, it may be advantageous to load the working portion 103 with higher and more consistent loads. Often in the prior art, bit whirl may cause sudden variations in the weight loaded to the working portion, such that drilling crews will purposefully load less weight to the bit than optimal to avoid damaging the drill bit.

Figure 12:
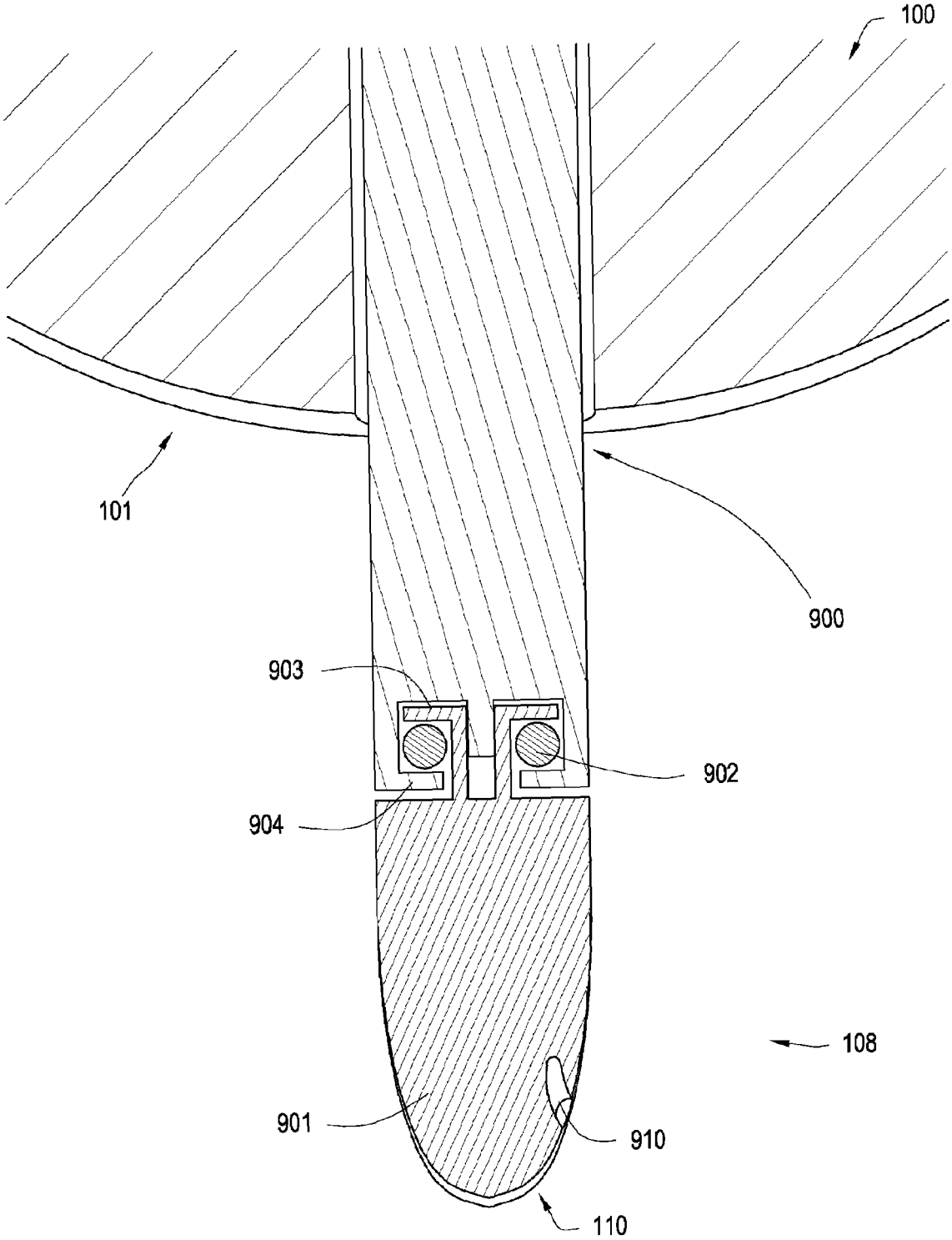
FIG. 12 is a cross sectional diagram of an embodiment of a distal end.

FIG. 12 is a cross sectional diagram of an embodiment of a distal end 110. A portion 900 of the shaft 108 is rotationally fixed to the body portion 101 of the drill bit assembly 100. The distal end 110 may comprise an insert 901 supported by rotary bearings 902 which rest on a shelf 904 formed in the shaft 108. Arms 903 may extend from the insert 901 and engage the bearings 902, allowing the insert 901 to be rotationally isolated from the body portion 101. The insert 901 may comprise a flute 910 to aid in rotationally fixing the insert 901 to the subterranean formation. During a drilling operation, the distal end 110 of the shaft 108 may be rotationally stationary with respect to the earth while the rest of the shaft 108 and the body portion 101 rotate together, but independently of the distal end 110.

Figure 13:
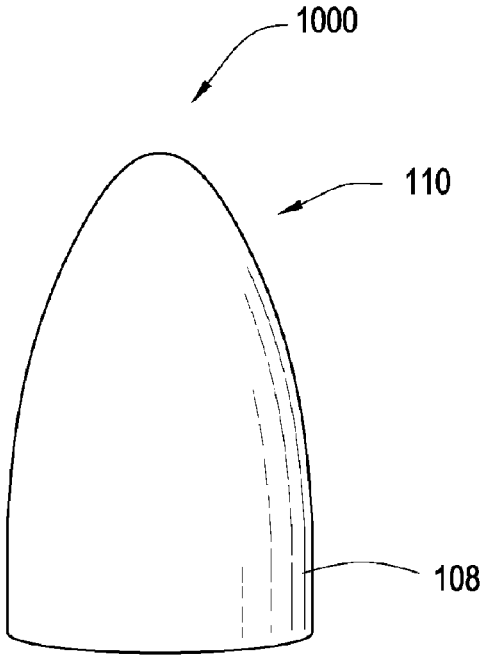
FIG. 13 is a perspective diagram of another embodiment of a distal end comprising a cone shape.
Figure 14:
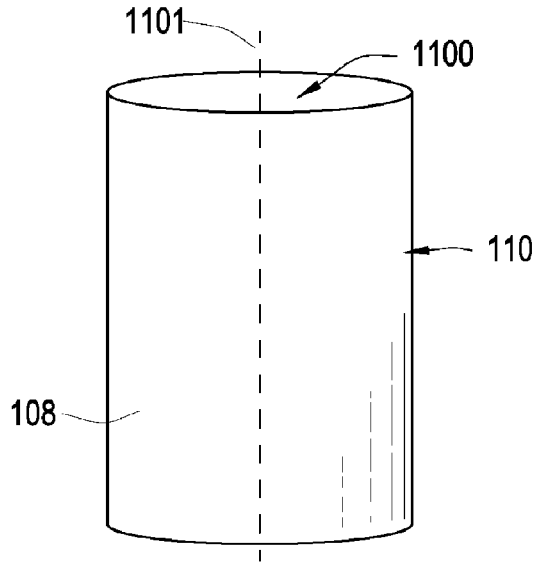
FIG. 14 is a perspective diagram of another embodiment of a distal end comprising a face normal to an axis of a shaft.
Figure 15:
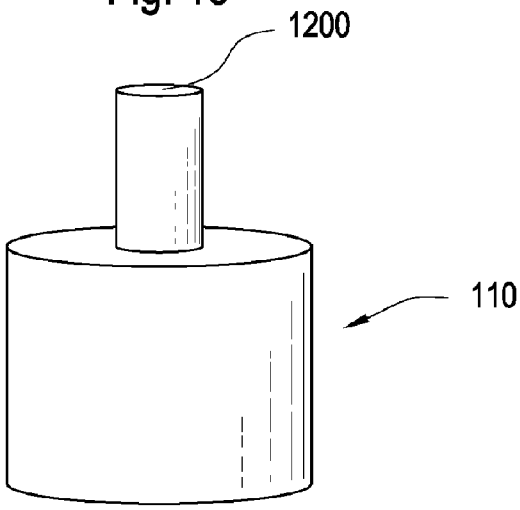
FIG. 15 is a perspective diagram of another embodiment of a distal end comprising a raised face.
Figure 16:
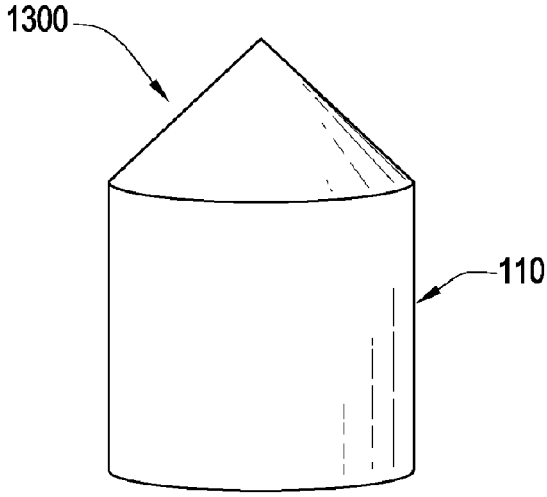
FIG. 16 is a perspective diagram of another embodiment of a distal end comprising a pointed tip.
Figure 17:
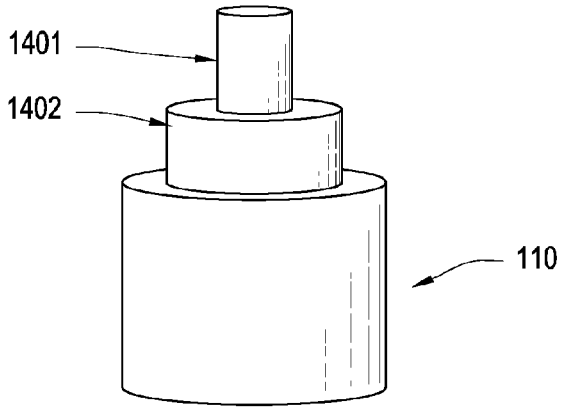
FIG. 17 is a perspective diagram of another embodiment of a distal end comprising a plurality of raised portions.
Figure 18:
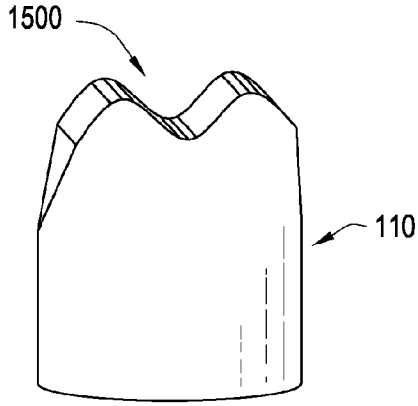
FIG. 18 is a perspective diagram of another embodiment of a distal end comprising a wave shaped face.
Figure 19:
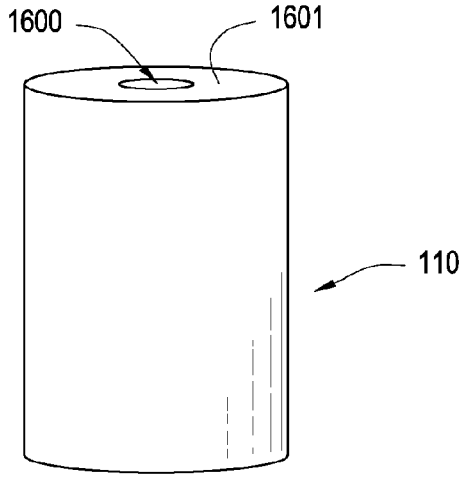
FIG. 19 is a perspective diagram of another embodiment of a distal end comprising a central bore.
Figure 20:
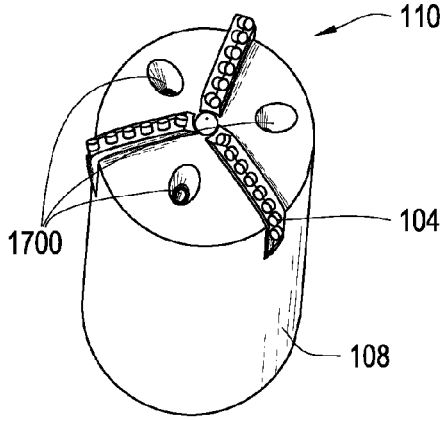
FIG. 20 is a perspective diagram of another embodiment of a distal end comprising a nozzle.

FIGS. 13–20 are perspective diagrams of various embodiments of the distal end 110 of the shaft 108. In FIG. 13 the distal end 110 comprises a plain cone 1000. FIG. 14 shows a distal end 110 with a face 1100 normal to a central axis 1101 of the shaft 108. FIG. 15 shows a distal end 110 with a raised face 1200. The distal end 110 of FIG. 16 comprises a pointed tip 1300. In other embodiments the distal end may comprise a rounded tip. The distal end 110, shown in FIG. 17, comprises a plurality of raised portions 1401, 1402. FIG. 18 is a perspective diagram of a distal end 110 with a wave shaped face 1500. FIG. 20 shows a distal end with a bore 1600 formed in an end face 1601. As shown in FIG. 20, at least one nozzle 1700 may be located at the distal end 110 to cool the shaft 108, circulate cuttings generated by the shaft 108, or erode a portion of the subsurface formation. Further the distal end 110 may also comprise at least one cutting element 104.

Figure 21:
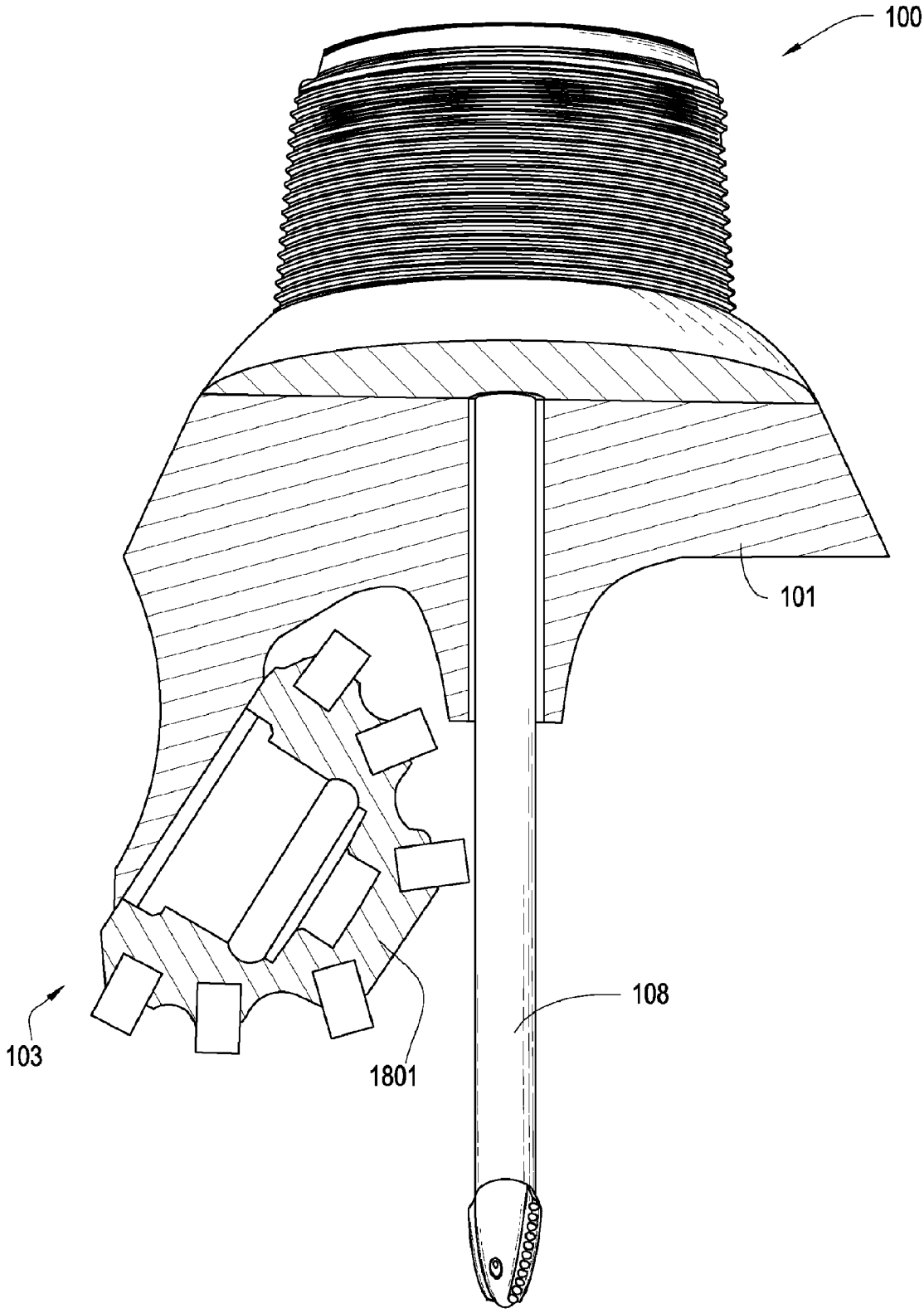
FIG. 21 is a perspective diagram of an embodiment of a roller cone drill bit assembly.

FIG. 21 is a perspective diagram of an embodiment of a drill bit assembly 100 comprising a working portion 103 with at least one roller cone 1801. The embodiment of this figure comprises shaft 108 extending beyond the body portion 101 and also the working portion 103 of the assembly 100. The shaft 108 may be positioned in the center of the working portion 103 so that the roller cones 1801 don't damage the shaft 108. The differential rotation between the rollers cones 1801 and the body portion 101 may be used to drive a pump (not shown) which may drive a hydraulic circuit and thereby be used to control the position of the shaft 108.

Figure 22:
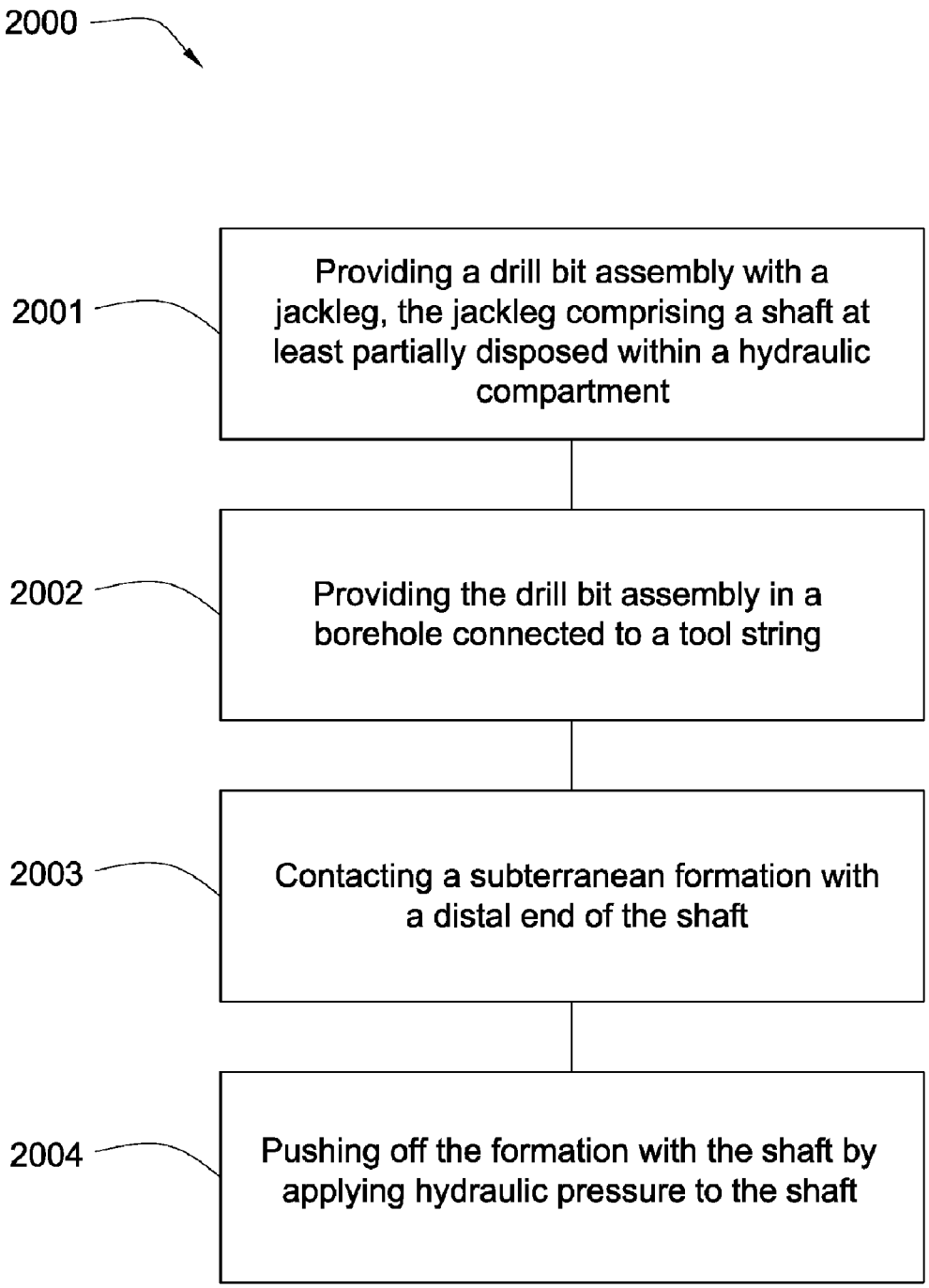
FIG. 22 is a diagram of a method for controlling the amount of weight loaded to the working portion of the drill bit assembly.

FIG. 22 is a diagram of a method 2000 for controlling the amount of weight loaded to the working portion of the drill bit assembly. The steps comprise providing 2001 a drill bit assembly with a jackleg, the jackleg comprising a shaft at least partially disposed within a hydraulic compartment, providing 2002 the drill bit assembly in a borehole connected to a tool string; contacting 2003 a subterranean formation with a distal end of the shaft, and pushing 2004 off the formation with the shaft by applying hydraulic pressure to the shaft. The method 2000 may further comprise a step of contacting the formation by the working portion of the drill bit assembly before the shaft contacts the formation.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a body portion intermediate a shank portion and a working portion;

the working portion comprising at least one cutting element and the body portion comprising at least a portion of a jackleg apparatus;

the jackleg apparatus comprising at least a portion of a shaft disposed within a chamber, the shaft comprising a distal end;

the jackleg apparatus comprises a hydraulic compartment adapted to displace the distal end of the shaft relative to the working portion; and the chamber comprising an opening proximate the working portion;

wherein the hydraulic compartment is part of a hydraulic circuit with an electrically controlled valve.

2. The drill bit assembly of claim 1, wherein at least a portion of the hydraulic compartment is disposed within the chamber.

3. The drill bit assembly of claim 1, wherein the shank portion is adapted for connection to a downhole tool string.

4. The drill bit assembly of claim 1, wherein the jackleg apparatus is generally coaxial with the shank portion.

5. The drill bit assembly of claim 1, wherein the distal end comprises a superhard material.

6. The drill bit assembly of claim 1, wherein the shaft is disposed within a sleeve rotationally isolated from the body portion.

7. The drill bit assembly of claim 1, wherein the distal end of the shaft is rotationally isolated from the body portion.

8. The drill bit assembly of claim 1, wherein during a drilling operation the distal end of the shaft is rotationally stationary with respect to a subterranean formation and the body portion rotates around the shaft.

9. The drill bit assembly of claim 1, wherein the shaft is retractable.

10. The drill bit assembly of claim 1, wherein the distal end of the shaft protrudes beyond the working portion.

11. The drill bit assembly of claim 1, wherein a sealing element is intermediate the shaft and a wall of the hydraulic compartment.

12. The drill bit assembly of claim 1, wherein the hydraulic compartment comprises a first and a second section separated by an enlarged portion of the shaft.

13. The drill bit assembly of claim 12, wherein a position of the shaft is determined by at least the pressures within the first and second sections of the hydraulic compartment.

14. The drill bit assembly of claim 1, wherein the hydraulic circuit comprises a pump.

15. The drill bit assembly of claim 14, wherein the pump comprises a first section rotationally fixed to the body portion and a second section rotationally isolated from the body portion.

16. The drill bit assembly of claim 15, wherein the second section is rotationally fixed to a roller cone, a sleeve disposed within the chamber, the shaft, or combinations thereof.

17. The drill bit assembly of claim 1, wherein the at least one electrically controlled valve is in communication with a downhole telemetry system.

18. The drill bit assembly of claim 1, wherein the body portion comprises at least one actuator adapted to open and/or close apertures in the hydraulic compartment.

19. A method for controlling weight loaded to a working portion of a drill bit assembly, comprising:

providing a drill bit assembly with a working portion and a jackleg disposed within at least a portion of the assembly, the jackleg comprising a shaft with a distal end and at least a portion of the shaft being disposed within a hydraulic compartment;

the hydraulic compartment being part of a hydraulic circuit with an electrically controlled valve;

providing the drill bit assembly in a borehole connected to a downhole tool string;

contacting a subterranean formation with the distal end of the shaft; and pushing off of the formation with the shaft by applying hydraulic pressure to the shaft.

20. The method of claim 19, wherein the method further comprises a step of contacting the formation by the working portion of the drill bit assembly before the shaft contacts the formation.

* * * * *